US007852270B2

(12) United States Patent
Yamada et al.

(10) Patent No.: US 7,852,270 B2
(45) Date of Patent: Dec. 14, 2010

(54) WIRELESS COMMUNICATION DEVICE

(75) Inventors: Atsushi Yamada, Tenri (JP); Keisuke Satoh, Osaka (JP); Hiroki Tanaka, Nara (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 328 days.

(21) Appl. No.: 12/203,547

(22) Filed: Sep. 3, 2008

(65) Prior Publication Data

US 2009/0066590 A1 Mar. 12, 2009

(30) Foreign Application Priority Data

Sep. 7, 2007 (JP) ..... 2007-233431
Jul. 1, 2008 (JP) ..... 2008-172496

(51) Int. Cl.
*H01Q 1/38* (2006.01)

(52) U.S. Cl. ..... 343/700 MS; 343/702; 343/786

(58) Field of Classification Search ..... 343/700 MS, 343/702, 772, 786, 846
See application file for complete search history.

(56) References Cited

U.S. PATENT DOCUMENTS 6,061,026 A * 5/2000 Ochi et al. ..... 343/700 MS
7,227,502 B2 * 6/2007 Yamamoto ..... 343/700 MS
7,236,070 B2 * 6/2007 Ajioka et al. ..... 333/247
2008/0042917 A1 * 2/2008 Seki et al. ..... 343/767

FOREIGN PATENT DOCUMENTS

JP 9-237867 A 9/1997

* cited by examiner

*Primary Examiner*—Hoang V Nguyen
(74) *Attorney, Agent, or Firm*—Birch, Stewart, Kolasch & Birch, LLP

(57) ABSTRACT

A wireless communication device including an antenna-integrated module which realizes a high-end antenna having an improved antenna efficiency includes a mounting board having a through hole whose cross-sectional shape is rectangular; and an antenna-integrated module mounted on the mounting board so as to cover over the through hole, a patch antenna, which radiates radiation wave, being provided on a surface of the antenna-integrated module, which surface is exposed in the through hole, an annular grounding sheet being provided between the antenna-integrated module and the mounting board so as to surround the patch antenna, and the through hole having a longer side whose length satisfies $\lambda/2 \leqq a \leqq \lambda$, where $\lambda$ is a wavelength of the radiation wave.

14 Claims, 9 Drawing Sheets

(a)

(b)

(c)

(a)

(b)

(a)

WITHOUT HORN ANTENNA (b)

h=11mm, c=6.5mm, d=5mm (c)

h=11mm, c=11.7mm, d=9mm (a)

(b)

(a)

(b)

(c)

(a)

(b)

(a)

(b)

WIRELESS COMMUNICATION DEVICE

This Nonprovisional application claims priority under U.S.C. §119(a) on Patent Application No. 233431/2007 filed in Japan on Sep. 7, 2007 and Patent Application No. 172496/2008 filed in Japan on Jul. 1, 2008, the entire contents of which are hereby incorporated by reference.

FIELD OF THE INVENTION

The present invention relates to a microwave and millimeter-wave wireless communication device having an antenna function.

BACKGROUND OF THE INVENTION

In recent years, wireless transmission of a high-definition video image signal has attracted attention. This necessitates transmitting of large capacity information, and therefore there have been attempts to develop a wireless video image transmission device using a millimeter-wave capable of securing a wide band. In a millimeter-wave band, when an antenna and a high frequency circuit are separately prepared and are then connected with each other via a connecting member such as a connecter, a large power loss occurs at their connecting section. For the purpose of reducing the power loss at the connecting section, an antenna-integrated module, in which an antenna and a high frequency circuit are included in a single module, has been developed.

An exemplary antenna-integrated module is disclosed in Patent Document 1 (Japanese Unexamined Patent Application Publication No. 237867/1997; published on Sep. 9, 1997). FIG. 7 is a drawing for explaining an arrangement of an antenna-integrated module included in a conventional wireless communication device. As shown in FIG. 7, this antenna-integrated module includes an antenna circuit board A and a high frequency board B which are stacked. The antenna circuit board A includes a first dielectric substrate 902 having an antenna element 903 and high frequency lines 904 and 905 via which electric power is supplied to the antenna element 903. The high frequency board B includes a second dielectric substrate 907 having (i) a cavity 908 in which a high frequency device 909 is contained and which is sealed by a cover 910, and (ii) transmission lines 911 and 912 via which a signal is transmitted to the high frequency device 909.

However, the following problem arises from an antenna-integrated module having the above arrangement. That is, most of high frequency signals generated in a high frequency circuit are radiated via an antenna. Some of the high frequency signals become respective surface wave that propagates over a surface of the antenna circuit board A, and then the respective surface wave is radiated from an end of the antenna circuit board A. When the size of the antenna-integrated module is decreased, the surface wave radiated from the end of the board greatly affects the antenna-integrated module, so that efficiency of the antenna is deteriorated.

SUMMARY OF THE INVENTION

An object of the present invention is to provide a wireless communication device including an antenna-integrated module which realizes a high-end antenna having an improved antenna efficiency.

In order to attain the object, a wireless communication device in accordance with the present invention is characterized by including a mounting board having a through hole whose cross-sectional shape is rectangular; and an antenna-integrated module mounted on the mounting board so as to cover over the through hole, a patch antenna, which radiates radiation wave, being provided on a surface of the antenna-integrated module, which surface is exposed in the through hole, an annular grounding section being provided between the antenna-integrated module and the mounting board so as to surround the patch antenna, and the through hole having a longer side whose length satisfies $\lambda/2 \leqq a \leqq \lambda$, where $\lambda$ is a wavelength of the radiation wave.

According to the characteristic, the length a of the longer side of the through hole satisfies $\lambda/2 \leqq a \leqq \lambda$, where $\lambda$ is the wavelength of the radiating wave. Therefore, it is possible to propagate, with low loss, only TE10 mode most suitable for radiation. When it is assumed that $a<\lambda/2$ is satisfied, the TE10 mode is cut off and is greatly attenuated (there is no other mode which can be propagated). When $a>\lambda$ is satisfied, a part of the TE10 mode is converted into TE20 mode. This causes a deterioration in efficiency.

In order to attain the above object, another wireless communication device in accordance with the present invention is characterized by including a mounting board having a through hole whose cross-sectional shape is circular; and an antenna-integrated module mounted on the mounting board so as to cover over the through hole, a patch antenna, which radiates radiation wave, being provided on a surface of the antenna-integrated module, which surface is exposed in the through hole, an annular grounding section being provided between the antenna-integrated module and the mounting board so as to surround the patch antenna, and the through hole having a diameter whose length satisfies $\lambda/1.706 \leqq e \leqq \lambda/1.3065$, where $\lambda$ is a wavelength of the radiation wave.

According to this characteristic, the diameter e of the through hole satisfies $\lambda/1.706 \leqq e \leqq \lambda/1.3065$, where $\lambda$ is the wavelength of the radiating wave. The dimension of $e=\lambda/1.706$ causes TE11 mode of circular waveguide to be cut off. When $e=\lambda/1.3065$ is satisfied, TM01 which is first higher mode of the circular waveguide is cut off. When $e<\lambda/1.706$ is satisfied, the TE11 mode is cut off and is greatly attenuated (there is no other mode which can be propagated). When $e>\lambda/1.3065$ is satisfied, a part of the TE11 mode is converted into the TM01 mode. This causes a deterioration in efficiency. Therefore, by causing the diameter e to satisfy $\lambda/1.706 \leqq e \leqq \lambda/1.3065$, it is possible to propagate, with low loss, only TE11 mode most suitable for radiation.

Additional objects, features, and strengths of the present invention will be made clear by the description below. Further, the advantages of the present invention will be evident from the following explanation in reference to the drawings.

Figure 3:
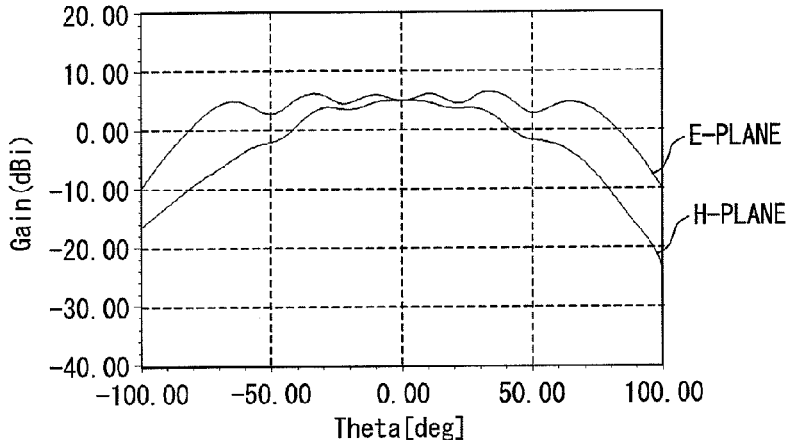
Figure 3:
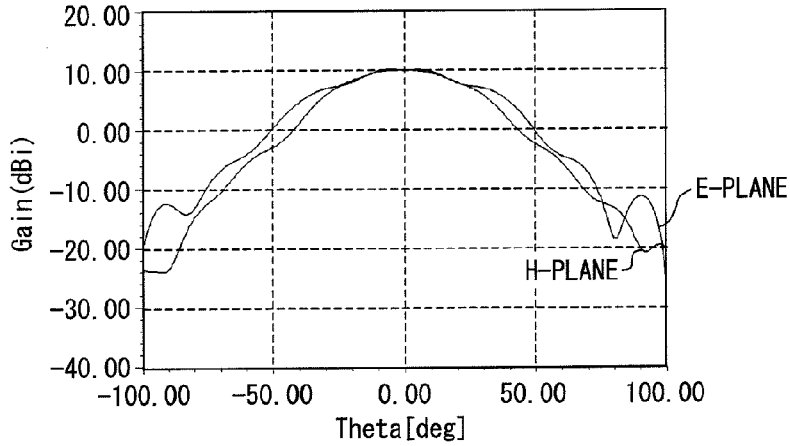
Figure 3:
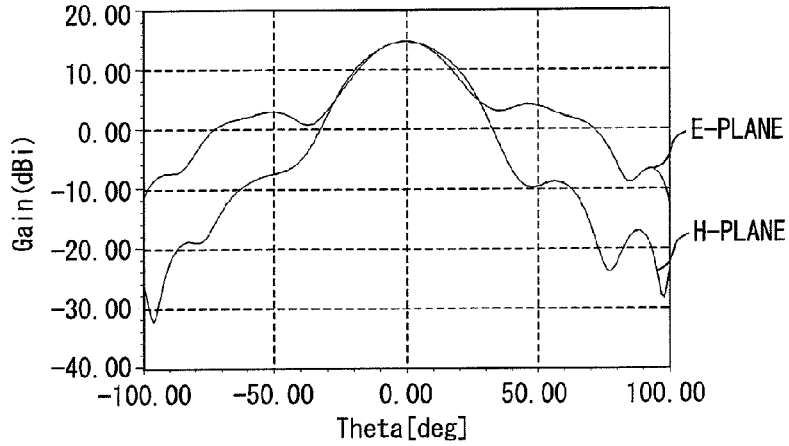

(a) through (c) of FIG. 3 are graphs showing radiation patterns of the wireless communication device.

Figure 4:
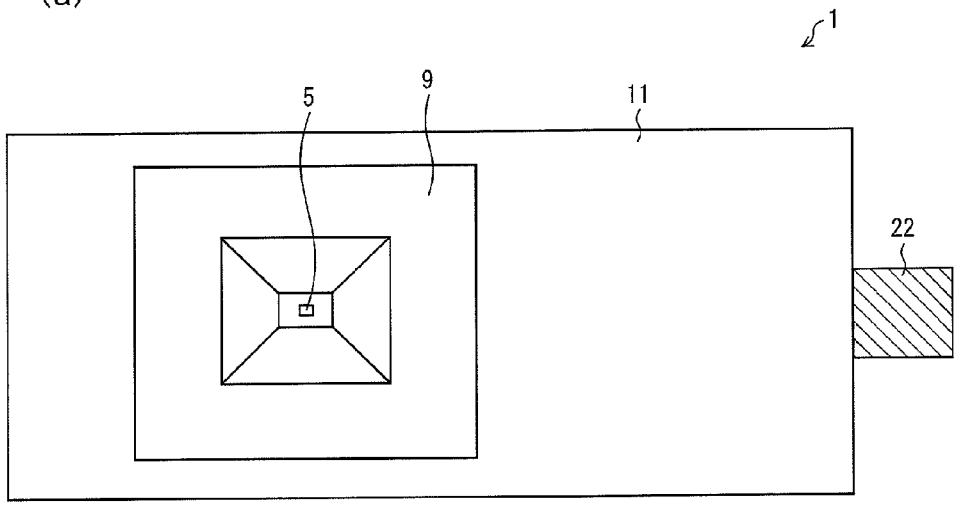
Figure 4:
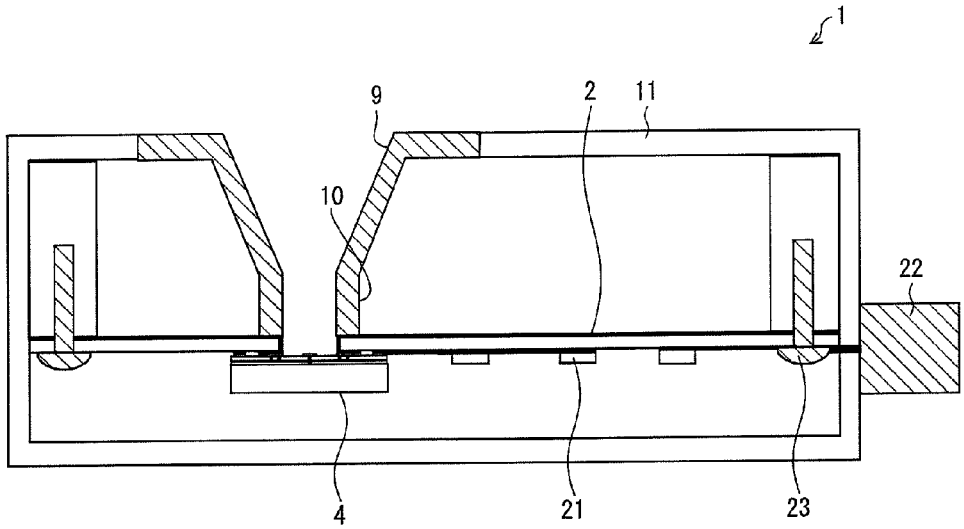

FIG. 4 is a drawing showing a housing of the wireless communication device, (a) of FIG. 4 is a plan view of the housing and (b) of FIG. 4 is a cross-sectional view of the housing.

Figure 5:
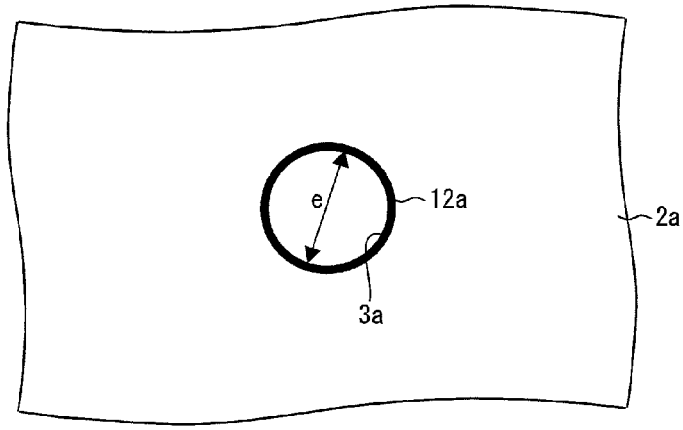
Figure 5:
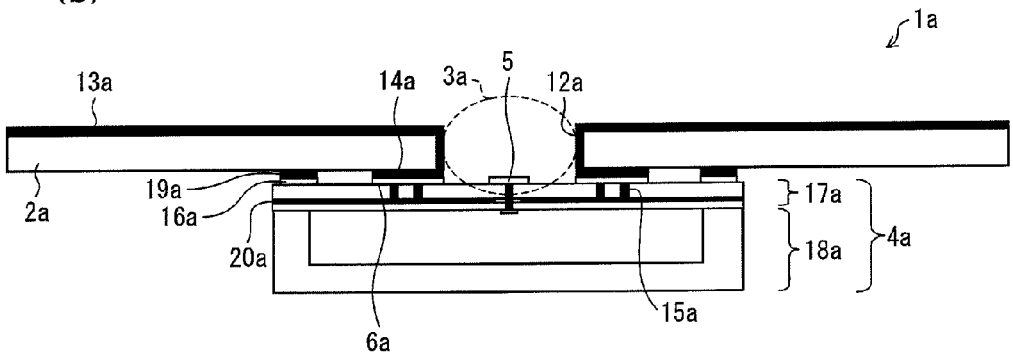
Figure 5:
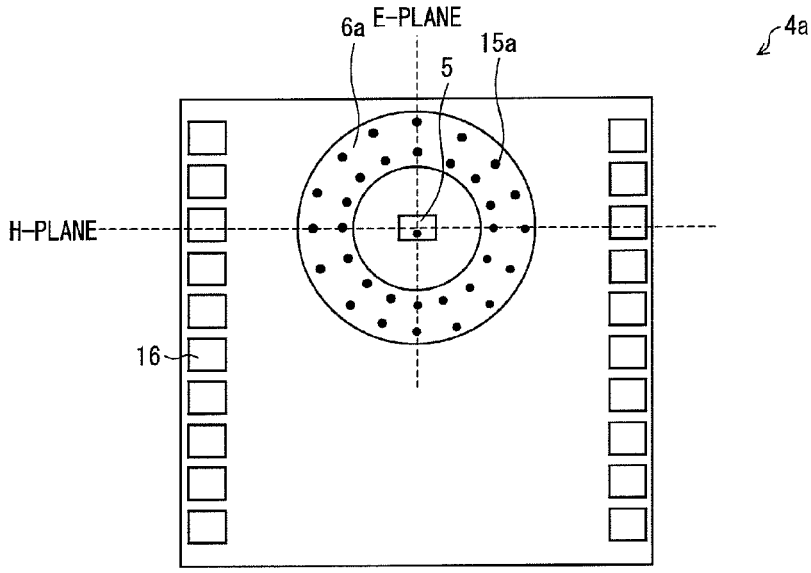

FIG. 5 is a drawing showing an arrangement of a wireless communication device in accordance with an Embodiment 2, (a) of FIG. 5 is a plan view of a mounting board provided in the wireless communication device, (b) of FIG. 5 is a cross-sectional view of the wireless communication device, and (c) of FIG. 5 is a plan view of an antenna-integrated module provided in the wireless communication device.

Figure 6:
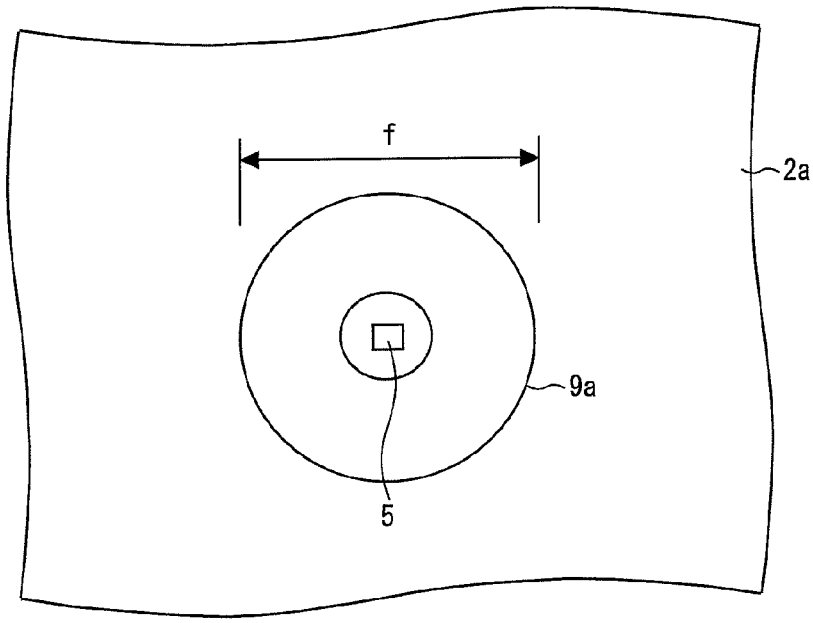
Figure 6:
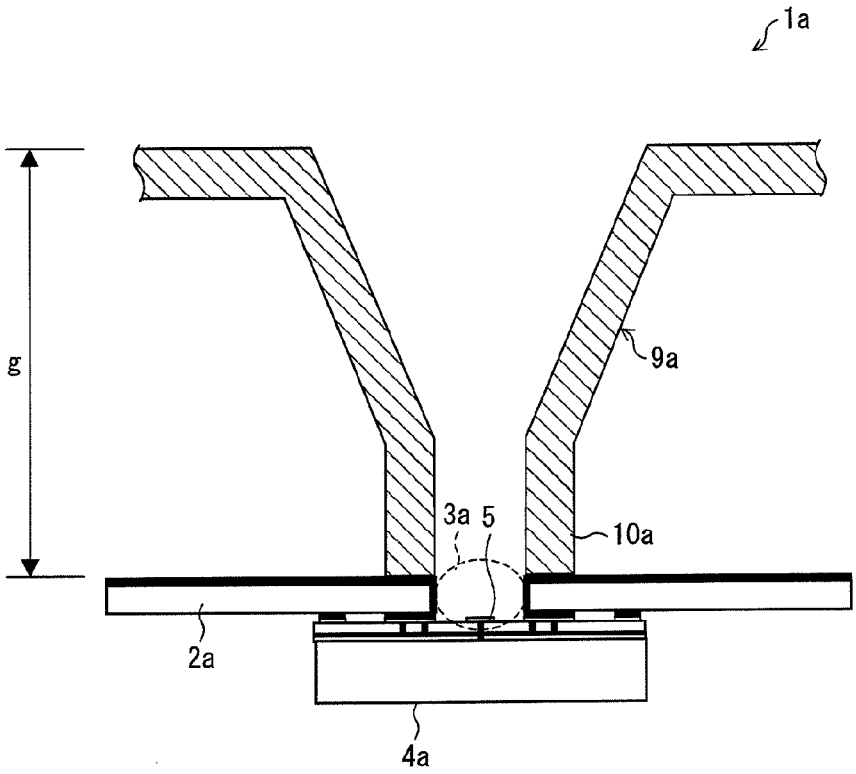

FIG. 6 is a drawing showing an arrangement of a horn antenna provided in the wireless communication device, (a) of FIG. 6 is a plan view of the horn antenna, and (b) of FIG. 6 is a cross-sectional view of the horn antenna.

Figure 7:
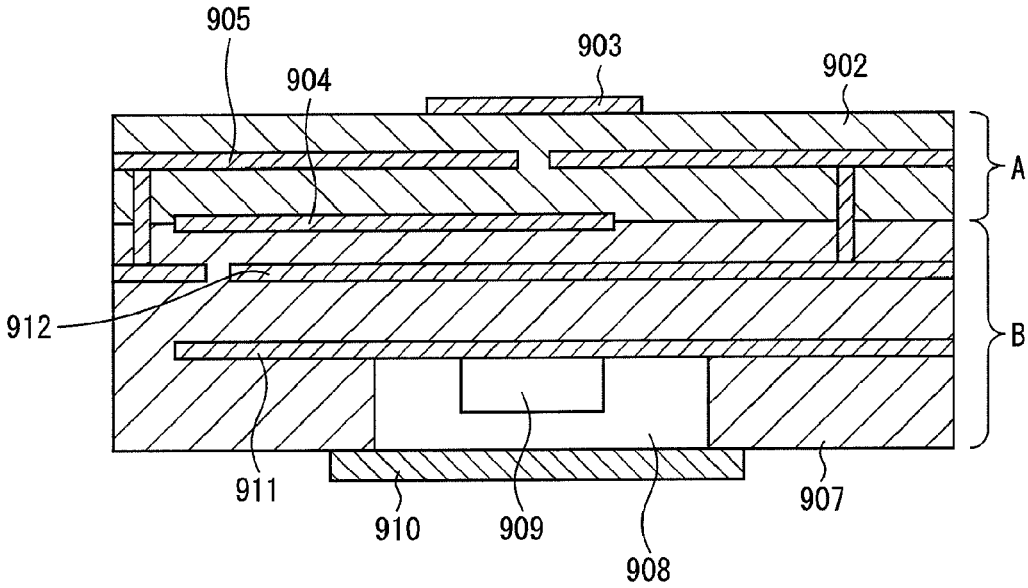

FIG. 7 is a drawing showing an arrangement of an antenna-integrated module provided in a conventional wireless communication device.

Figure 8:
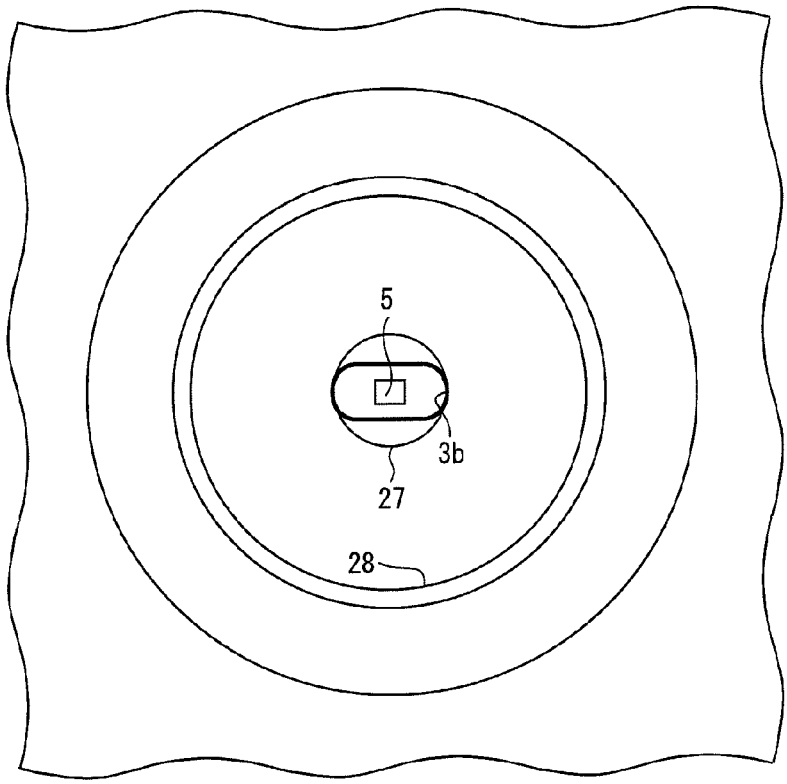
Figure 8:
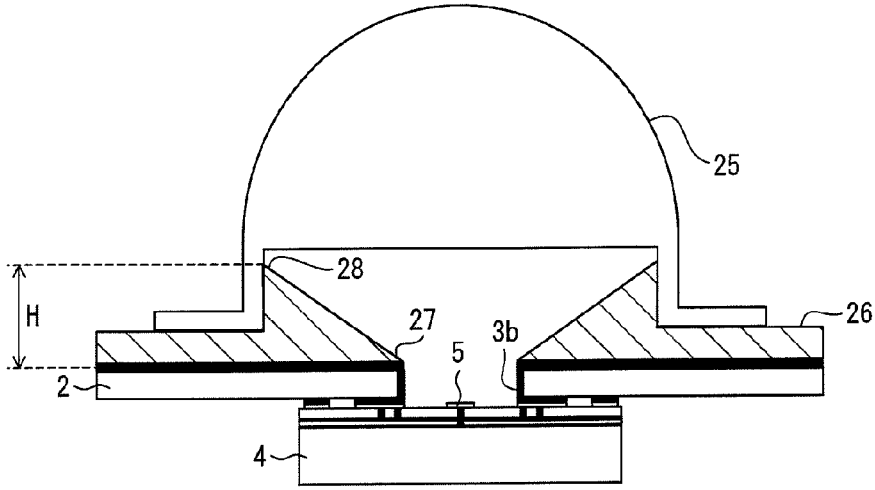

FIG. 8 is a drawing showing an arrangement of a wireless communication device in accordance with an Embodiment 3, (a) of FIG. 8 is a plan view of the wireless communication device, and (b) of FIG. 8 is an elevation cross-sectional view of the wireless communication device.

Figure 9:
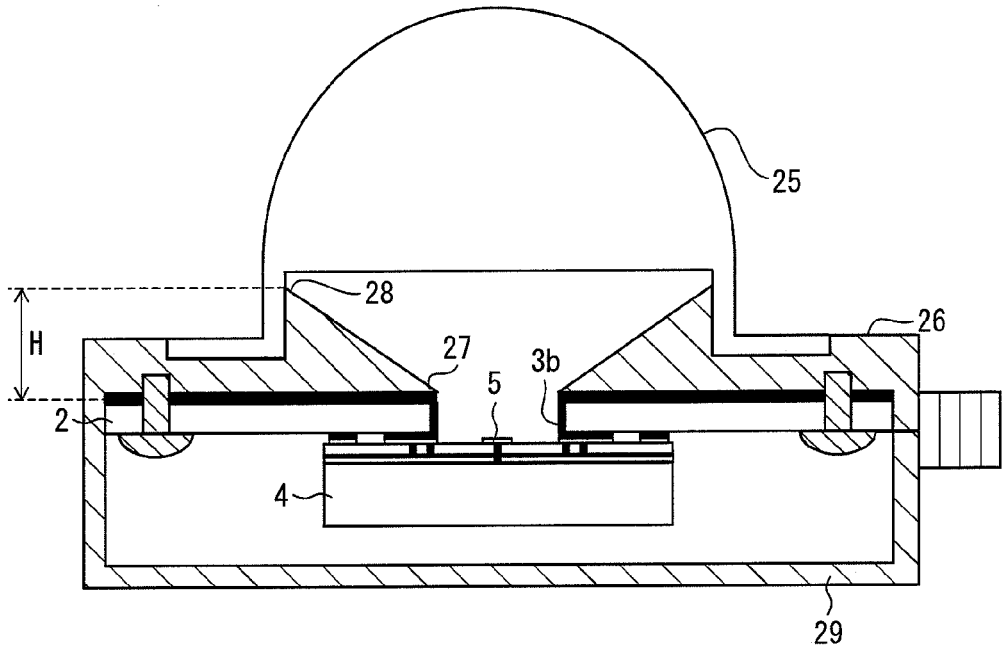

FIG. 9 is an elevation cross-sectional view showing an arrangement of another wireless communication device in accordance with the Embodiment 3.

DESCRIPTION OF THE EMBODIMENTS

The following description deals with an embodiment of the present invention with reference to FIGS. 1 through 6 and FIGS. 8 and 9.

Embodiment 1

Figure 1:
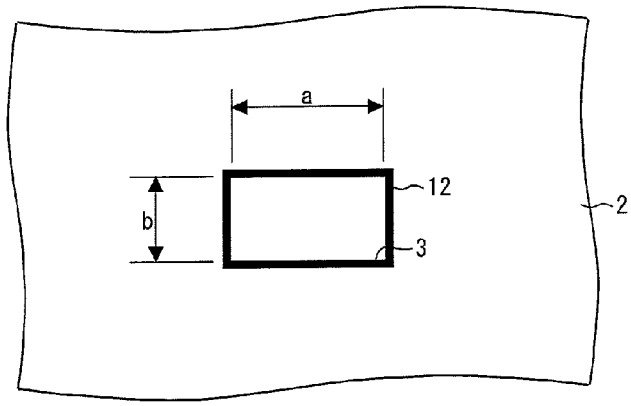
FIG. 1 is a drawing showing an arrangement of a wireless communication device in accordance with an Embodiment 1, (a) of FIG. 1 is a plan view of a mounting board provided in the wireless communication device, (b) of FIG. 1 is a cross-sectional view of the wireless communication device, and (c) of FIG. 1 is a plan view of an antenna-integrated module provided in the wireless communication device.
Figure 1:
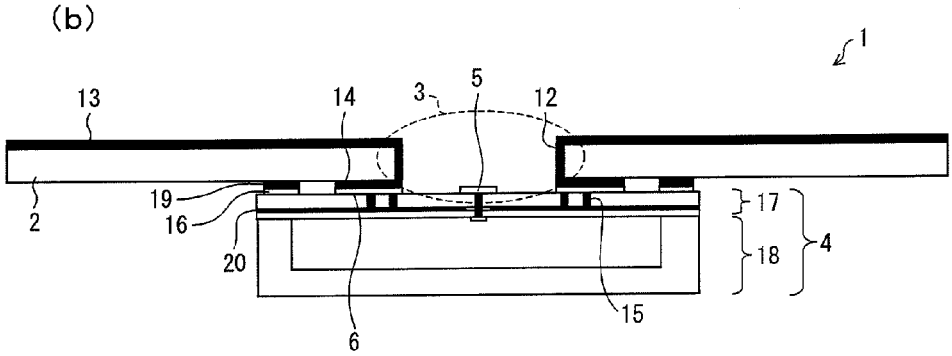
Figure 1:
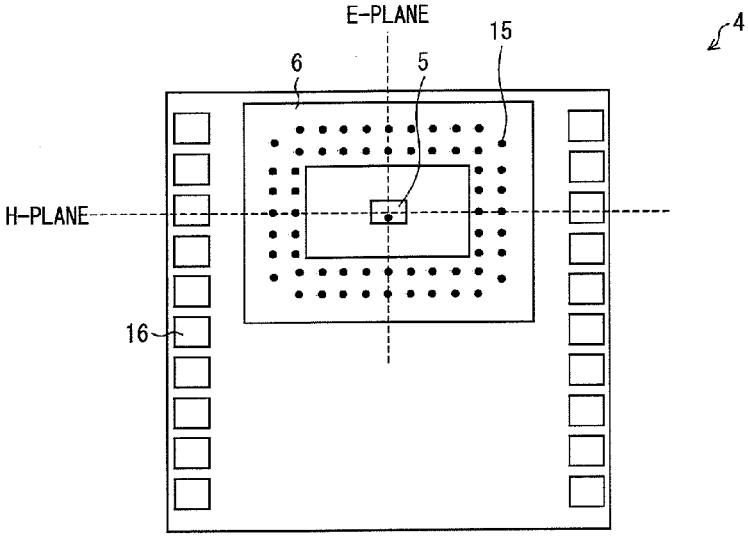

FIG. 1 is a drawing showing an arrangement of a wireless communication device 1 in accordance with an Embodiment 1, (a) of FIG. 1 is a plan view of a mounting board 2 provided in the wireless communication device 1, (b) of FIG. 1 is a cross-sectional view of the wireless communication device 1, and (c) of FIG. 1 is a plan view of an antenna-integrated module 4 provided in the wireless communication device 1.

(c) of FIG. 1 is a drawing obtained when the antenna-integrated module 4 is seen from a surface on which an antenna is provided. (a) of FIG. 1 shows lengths a and b of a through hole 3 provided in the mounting board 2.

The wireless communication device 1 includes the mounting board 2. The mounting board 2 has the through hole 3 having a rectangular cross-sectional shape. The antenna-integrated module 4, covering the through hole 3, which is mounted onto the mounting board 2 is provided in the wireless communication device 1. The antenna-integrated module 4 has a surface, exposed in the through hole 3, on which a patch antenna 5, via which radiation wave is radiated, is provided. An annular grounding sheet 6 is provided, along an inner wall of the through hole 3, between the antenna-integrated module 4 and the mounting board 2 so as to surround the patch antenna 5.

The length a of a longer side of the through hole 3 is provided to satisfy $\lambda/2 \leqq a \leqq \lambda$, where $\lambda$ is a wavelength of the radiation wave radiated by the patch antenna 5. This allows only a TE10 mode which is most suitable for radiation to be propagated with low loss. When $a<\lambda/2$ is satisfied for example, the TE10 mode is cut off and is therefore greatly attenuated (there is no other mode which can be propagated). When $a>\lambda$ is satisfied, a part of the TE10 mode is converted into a TE20 mode, and efficiency deteriorates.

The length b of a shorter side of the through hole 3 is provided to satisfy $0<b \leqq \lambda/2$, where $\lambda$ is a wavelength of the radiation wave.

When the length b of the shorter side of the through hole 3 is set to satisfy $0<b \leqq \lambda/2$, where $\lambda$ is a wavelength of the radiation wave radiated by the patch antenna 5, electromagnetic wave perpendicular to electromagnetic wave is cut off, and therefore polarization ratio can be improved. In a case where $b>\lambda/2$ is satisfied, for example, when a factor such as non-uniformity causes structural balance in a horizontal direction, the electromagnetic wave perpendicular to the electromagnetic wave is likely to occur and lower the polarization ratio. In a case where $b=a/2$ is set to be satisfied, $b=\lambda/2$ is satisfied even when the length a is equal to a maximum value $\lambda$. This causes the electromagnetic wave perpendicular to the electromagnetic wave to be cut off.

An inner wall conductor 12 is formed on an inner wall of the through hole 3 so as to electrically connect a surface conductor 13 and a rear surface conductor 14 each provided on the mounting board 2.

The antenna-integrated module 4 is constituted by an antenna-integrated module substrate 17 and a cover 18. A plurality of connecting terminals 16 are formed at a predetermined pitch on an antenna surface of the antenna-integrated module substrate 17 so that the annular grounding sheet 6 is sandwiched between the connecting terminals 16 and the antenna-integrated module substrate 17.

The antenna-integrated module substrate 17 includes a plurality of through holes 15, formed at a predetermined pitch, in an area over which area the annular grounding sheet 6 is provided. The annular grounding sheet 6 is connected, via the through holes 15, to a module inner layer substrate 20 formed in the antenna-integrated module substrate 17. The antenna-integrated module substrate 17 is realized by a multilayer substrate made of ceramic calcined at a low temperature.

The mounting board 2 has a grounding surface, facing the antenna-integrated module 4, which is electrically connected to the surface conductor 13 which is provided on a surface opposite to the grounding surface, via the inner wall conductor 12 formed on the through hole 3. The mounting board 2 is made of glass epoxy printed circuit board.

The annular grounding sheet 6 on the antenna-integrated module substrate 17 and the rear surface conductor 14 (grounding surface) on the mounting substrate 2 are connected with each other by solder (not shown). Further, the connecting terminals 16 on the antenna-integrated module 4 are connected, by solder, to connecting terminals 19 on the mounting substrate 2, respectively. Further, the part of the mounting board 2 which faces an area, on the antenna-integrated module 4, surrounded by the annular grounding sheet 6 becomes the through hole 3 formed by a drill. The inner wall conductor 12 is formed on the inner wall of the through hole 3. As shown in (a) of FIG. 1, the through hole 3 has a rectangular cross-sectional shape which has the same size as a waveguide standard WR-15, that is, a=3.8 mm, and b=1.9 mm. It should be noted that the cross-sectional shape of the through hole 3 does not necessarily need to be a perfect rectangular. A round shape formed by a drill at a time of forming a through hole may remain at the four corners of the through hole.

The patch antenna 5 is connected, via the through hole 15, to a high frequency circuit (not shown) formed on an opposite surface of the mounting substrate 2. The high frequency circuit includes a transmission line and a semiconductor integrated circuit which are provided on the substrate 17.

The following description explains how the wireless communication device 1, serving as a 60 GHz band-transmitter, operates. Most of high frequency signals in the 60 GHz band generated at the high frequency circuit is radiated from the patch antenna 5 into the air. However, an area formed by the annular grounding sheet 6, the rear surface conductor 14, the inner layer substrate 20, the through hole 15 and the inner wall conductor 12 serves as a metal wall causing radio wave to be shut in the area. This causes the radio wave to propagate only in a front direction (a direction perpendicular to a direction to be headed to the substrate 17 of the antenna-integrated module 4 from the patch antenna 5). According to the waveguide standard WR-15, only the TE10 mode whose frequency falls within approximately 50-75 GHz is propagated. The through hole 3 has substantially the same size as the waveguide standard WR-15. Therefore, the high frequency signals in the 60 GHz band radiated from the patch antenna 5, without being converted into higher modes, propagate along the through hole 3, are directed in the front direction, and are then radiated. Because the inner wall conductor 12 is provided on the inner wall of the through hole 3, the high frequency signals have almost no loss during their propagating along the through hole 3. The shape of an opening of the through hole 3 may be different from the waveguide standard, provided that the length a of the longer side satisfies $\lambda/2 \leqq a \leqq \lambda$, where $\lambda$ is the wavelength of the radiation wave. Note that the dimension of $a=\lambda/2$ causes a rectangular waveguide TE10 mode to be cut off. The dimension of $a=\lambda$ causes the TE20 mode, which is the first higher mode of the rectangular waveguide, to be cut off. However, when the opening of the through hole 3 is set to have the same shape as the waveguide standard, an antenna and a measure can be connected with each other via the waveguide. This allows a reduction in inspection time during mass production.

An antenna-integrated module 4 may be realized by a multilayer substrate made of high temperature calcinated ceramic. The mounting substrate 2 may be realized by a Teflon printed circuit board. Further, by changing a circuit configuration of the high frequency circuit (not shown), an antenna-integrated module 4 can be used as a receiver.

Figure 2:
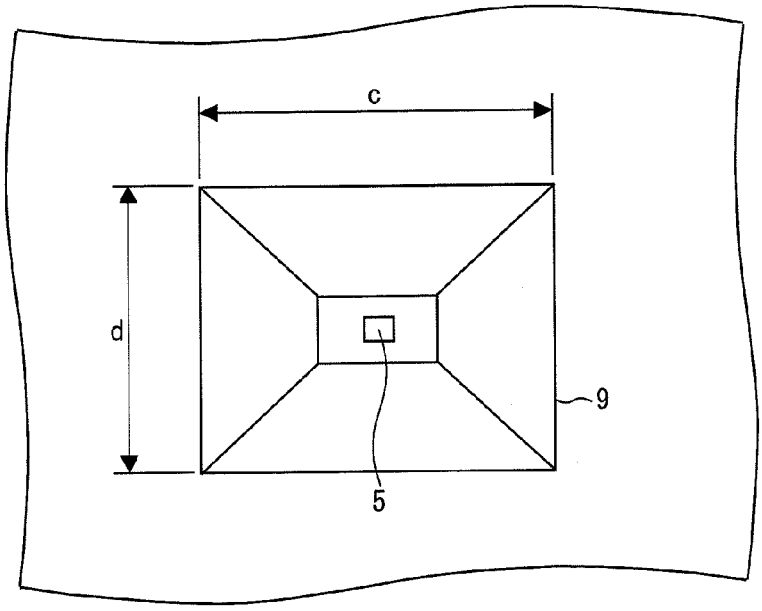
FIG. 2 is a drawing showing an arrangement of a horn antenna provided in the wireless communication device, (a) of FIG. 2 is a plan view of the horn antenna and (b) of FIG. 2 is a cross-sectional view of the horn antenna.
Figure 2:
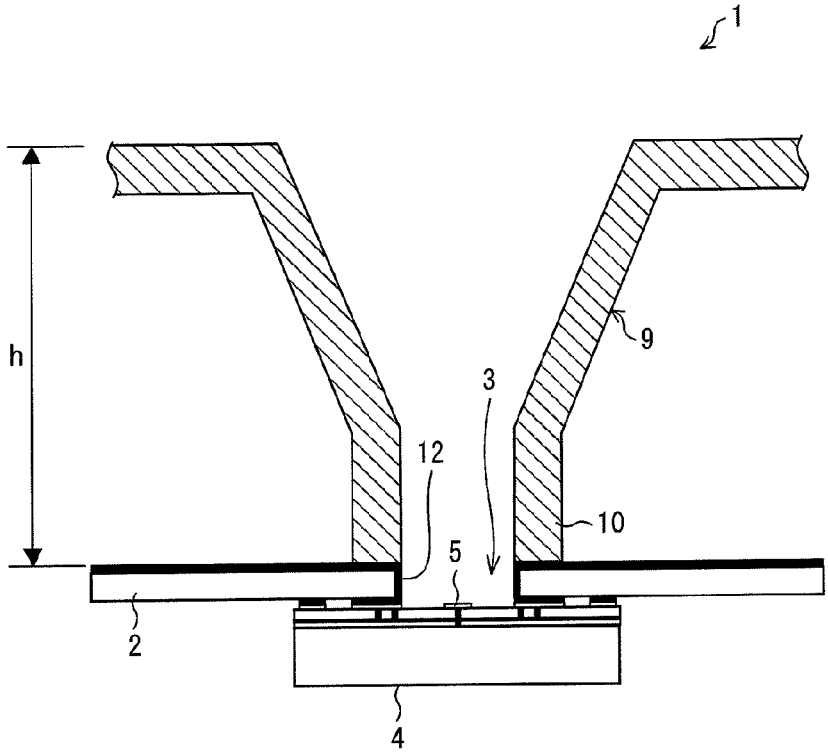

FIG. 2 is a drawing showing an arrangement of a horn antenna 9 provided on the wireless communication device 1. (a) of FIG. 2 is a plan view of the horn antenna 9, and (b) of FIG. 2 is an elevation cross-sectional view of the horn antenna 9. The horn antenna 9 including a connecting section 10 whose opening has substantially the same size as the through hole 3 is connected to the through hole 3.

Such an arrangement is different from that shown in FIG. 1 in that the horn antenna 9 including the connecting section 10 whose opening has substantially the same size as that of the through hole 3 (i.e. the opening size of the waveguide standard WR-15) is connected to an opening section on a front side of the through hole 3 of the mounting board 2. The horn antenna 9 is realized by metal such as aluminum. By appropriately setting the length h of the horn antenna and opening size c and d at an end section, it is possible to realize a desired directional antenna.

It is also possible to realize a directional antenna with the use of a dielectric lens. However, a combination of the dielectric lens and the patch antenna 5 would make it impossible to cause all the radiation wave from the patch antenna 5 to enter into the dielectric lens. On this account, portion of the radiation wave spills over from the dielectric lens. Therefore, the antenna efficiency deteriorates. In contrast, when a horn antenna 9 of the present embodiment is adopted, all the radio wave radiated from the patch antenna 5 is radiated from the horn antenna 9. Therefore, it is possible to realize an antenna with high efficiency.

(a) through (c) of FIG. 3 are graphs showing radiation patterns of the wireless communication device 1. Specifically, (a) of FIG. 3 is a graph showing a radiation pattern obtained when the horn antenna 9 is not provided. (b) of FIG. 3 is a graph showing a radiation pattern obtained when h=11 mm, c=6.5 mm, and d=5 mm are satisfied in the arrangement shown in (a) and (b) of FIG. 2. (c) of FIG. 3 is a graph showing a radiation pattern obtained when h=11 mm, c=11.7 mm, and d=9 mm in the arrangement shown in (a) and (b) of FIG. 2. A horizontal axis indicates an angle to the front direction, and a vertical axis indicates an antenna gain. The antenna gains in the front direction are about 5 dBi in (a) of FIG. 3, about 10 dBi in (b) of FIG. 3, and about 15 dBi in (c) of FIG. 3, respectively. It is clear that an antenna gain can be adjusted based on how the dimension of the opening in the horn antenna 9 is set.

FIG. 4 is a drawing showing a housing 11 of a wireless communication device. (a) of FIG. 4 is a plan view of the housing 11 and (b) of FIG. 4 is a cross-sectional view of the housing 11. FIG. 4 illustrates a wireless communication device in which the wireless communication device shown in FIG. 2 is incorporated into a housing 11. The housing 11 is made of plastic. (i) Surface mount parts, such as capacitors, resistors and (ii) an antenna-integrated module 4 are mounted on a mounting board 2. The horn antenna 9 is attached to the housing 11 with attaching members such as screws (not shown).

The mounting board 2 is attached to the inside of the housing 11 with screws 23. By appropriately setting the height of the horn antenna 9, it is possible for the connecting section of the horn antenna 9 to come into contact with the mounting board 2 when the mounting board 2 is attached to the housing 11. With the arrangement, a horn antenna 9 can be incorporated into a compact and light wireless communication device 1, unlike a conventional arrangement in which a horn antenna is only permitted to be combined with a waveguide component. This allows a wireless communication device having excellent antenna characteristic to be realized.

Further, the housing 11 is realized by plastic so as to reduce its weight. The plastic normally has low heat conductivity and poor heat radiation. However, by causing the horn antenna 9 made of metal to come into contact with the mounting board 2, heat generated in the antenna-integrated module 4 is promptly radiated into the air via the horn antenna 9. This causes the heat not to remain in the housing 11. This brought about a secondary effect of improving reliability of the wireless communication device 1.

As described above, according to Embodiment 1, the high frequency signals radiated from the patch antenna 5 are propagated only in the front direction, without being converted into the higher modes. This allows an increase in antenna efficiency.

Further, since the wireless communication device is easily connected to a standardized rectangular waveguide, it becomes possible to shorten the inspection time.

Embodiment 2

FIG. 5 is a drawing showing an arrangement of a wireless communication device 1*a* in accordance with an Embodiment 2. (a) of FIG. 5 is a plan view of a mounting board 2*a* provided in the wireless communication device 1*a*. (b) of FIG. 5 is a cross-sectional view of the wireless communication device 1*a*. (c) of FIG. 5 is a plan view of an antenna-integrated module 4*a* provided in the wireless communication device 1*a*.

Constituent members which are identical with or similar to those in Embodiment 1 are given identical or similar reference numerals and are not explained repeatedly. The difference from the Embodiment 1 resides in that an annular grounding sheet 6*a* and a through hole 3*a* have circular openings.

The wireless communication device 1*a* includes the mounting board 2*a*. The through hole 3*a* whose cross-sectional shape is circular is formed in the mounting board 2*a*. In the wireless communication device 1*a*, the antenna-integrated module 4*a* is mounted on the mounting board 2*a* so as to cover over the through hole 3*a*. A patch antenna 5, which radiates radiation wave, is provided on a surface of the antenna-integrated module 4*a*, which surface is exposed in the through hole 3*a*. An annular grounding section 6*a* is provided, along an inner wall of the through hole 3*a*, between the antenna-integrated module 4*a* and the mounting board 2*a* so as to surround the patch antenna 5.

The through hole 3*a* has a diameter e which satisfies $\lambda/1.706 \leqq e \leqq \lambda/1.3065$, where $\lambda$ is a wavelength of the radiating wave from the patch antenna 5.

The dimension of $e=\lambda/1.706$ causes TE11 mode of circular waveguide to be cut off. When $e=\lambda/1.3065$ is satisfied, TM01 which is first higher mode of the circular waveguide is cut off. When $e<\lambda/1.706$ is satisfied, the TE11 mode is cut off and is greatly attenuated (there is no other mode which can be propagated). When $e>\lambda/1.3065$ is satisfied, a part of the TE11 mode is converted into the TM01 mode. This causes a deterioration in efficiency. Therefore, by causing the diameter e to satisfy $\lambda/1.706 \leqq e \leqq \lambda/1.3065$, it is possible to propagate, with low loss, only TE11 mode most suitable for radiation.

The diameter e of the through hole 3 is set to 3.58 mm. This diameter falls within a V band Medium size which is waveguide standard, and the TE11 mode whose frequency falls within approximately 58-68 GHz can pass through. The shape of an opening of the through hole 3*a* may be different from the waveguide standard. Provided that the diameter e satisfies $\lambda/1.706 \leqq e \leqq \lambda/1.3065$, where $\lambda$ is the wavelength of the radiation wave, the radio wave can be directed in the front direction, without being converted into the higher modes. Note that the dimension of $e=\lambda/1.706$ causes a circular waveguide TE11 mode to be cut off. The dimension of $e=\lambda/1.3065$ causes the TM01 mode, which is the first higher mode of the circular waveguide, to be cut off.

FIG. 6 is a drawing showing an arrangement of a horn antenna 9*a* provided in the wireless communication device 1*a*. (a) of FIG. 6 is a plan view of the horn antenna 9*a* and (b) of FIG. 6 is a cross-sectional view of the horn antenna 9*a*. The arrangement of the horn antenna 9*a* is different from that shown in FIG. 5 in that the horn antenna 9*a* including the connecting section 10*a* whose opening has substantially the same size as that of the through hole 3*a* (i.e. the V band Medium size which is waveguide standard) is connected to an opening section on a front side of the through hole 3*a* of the mounting board 2*a*.

The horn antenna 9*a* is realized by metal such as aluminum. By appropriately setting the length g of the horn antenna and diameter f of the opening section at an end section, it is possible to realize a desired directional antenna.

It is also possible to incorporate a wireless communication device of Embodiment 2 into a housing, like the arrangement shown in FIG. 4 of Embodiment 1.

As described above, according to Embodiment 2, the high frequency signals radiated from the patch antenna 5 is propagated only in the front direction without being converted into the higher modes, because the through hole 3*a* is set so as to have a diameter e which satisfies $\lambda/1.706<e<\lambda/1.3065$, where $\lambda$ is a wavelength of the radiation wave. This allows an improvement in antenna efficiency.

Explained in Embodiments 1 and 2 are exemplary cases in which the through hole has a rectangular or circular cross-sectional shape. It should be noted that the present invention is not limited to this. Alternatively, the through hole may have an elliptic cross-sectional shape.

Embodiment 3

FIG. 8 is a drawing showing an arrangement in which a mortar structure 26 and a dielectric lens 25 are provided in the wireless communication device 1 described in the Embodiment 1, (a) of FIG. 8 is a plan view of the arrangement, and (b) of FIG. 8 is an elevation cross-sectional view of the arrangement.

Such an arrangement is different from the horn antenna 9 shown in FIG. 2 in that (i) the mortar structure 26 having a lower circular opening 27 and an upper circular opening 28 is provided above a through hole 3*b*, and (ii) the dielectric lens 25 is provided so as to cover the upper circular opening 28. The mortar structure 26 is set to have a depth H so that the dielectric lens 25 has a focal point positioned on the center of the lower circular opening 27.

Further, the through hole 3*b* shown in (a) of FIG. 8 is an exemplary through hole formed by a drill. Each of shorter sides of the through hole 3*b* has a semicircular shape.

The lower circular opening 27 of the mortar structure 26 is set to have a diameter of substantially the same length as a longer side of the through hole 3*b*.

The mortar structure 26 is made of metal such as aluminum. Further, the dielectric lens 25 is made of low-loss material such as polypropylene, polyethylene or Tefron.

Like the operation described in the Embodiment 1, most of high frequency signals generated by a high frequency circuit in an antenna-integrated module 4 are radiated from a patch antenna 5 (see FIG. 2) into the air, propagate along the through hole 3, are directed in the front direction, and are then radiated. The high frequency signals radiated from the through hole 3*b* are radiated with spread. However, the spread is limited by an inner wall of the mortar structure 26. Therefore, the high frequency signals do not spill over from the dielectric lens 25, and all of the high frequency signals enter into a rear surface of the dielectric lens 25. The through hole 3*b* can be regarded as a point wave source of the dielectric lens 25, and the dielectric lens 25 is provided so that the focal point is positioned at the center of the lower circular opening 27. As such, all the electromagnetic waves which enter into the dielectric lens 25 are converted into plane waves having the same phase by the dielectric lens 25. This allows an improvement in antenna gain.

When the diameter of the lower circular opening 27 is set to have substantially the same length as the longer side of the through hole 3*b*, almost no scattering surface exists along a route defined between the lower circular opening 27 and the upper circular opening 28. Therefore, the wave radiated from the through hole 3*b* is not scattered but enters into the dielectric lens 25.

Further, the upper circular opening 28 has a diameter of substantially the same as the dielectric lens 25. This makes it possible to cause the wave radiated from the through hole 3*b* to effectively enter into a periphery of the dielectric lens 25. This allows an increase in aperture efficiency of the dielectric lens 25.

FIG. 9 illustrates a wireless communication device in which a wireless communication device shown in FIG. 8 is incorporated into a housing 29. A mortar structure 26 shown in FIG. 8 is formed so as to be integral with the housing 29. (i) Surface mount parts, such as capacitors, resistors and (ii) the antenna-integrated module 4 are mounted on a mounting board 2 in the housing 29. By thus forming the mortar structure 26 on the housing 29, it is possible to realize a compact wireless communication device having an excellent antenna characteristic.

The present invention is not limited to the description of the embodiments above, but may be altered by a skilled person within the scope of the claims. An embodiment based on a proper combination of technical means disclosed in different embodiments is encompassed in the technical scope of the present invention.

The present invention can be applied to a microwave and millimeter-wave wireless communication device having an antenna function. Further, the present invention is effective in realizing a compact and high-end wireless communication device, and can be applied to a device such as a wireless transmission device of a high-definition video image signal.

In the wireless communication device in accordance with the present embodiment, it is preferable that the through hole has a shorter side whose length b satisfies $0<b\leqq\lambda/2$, where $\lambda$ is a wavelength of the radiation wave.

With the arrangement, the length b of the shorter side of the through hole satisfies $0<b\leqq\lambda/2$, where $\lambda$ is a wavelength of the radiation wave. Therefore, electromagnetic wave perpendicular to electromagnetic wave is cut off, and a polarization ratio can be improved. In a case where $b>\lambda/2$ is satisfied, for example, when a factor such as non-uniformity causes structural balance in a horizontal direction, the electromagnetic wave perpendicular to the electromagnetic wave is likely to occur and lower the polarization ratio. In a case where $b=a/2$ is set to be satisfied, $b=\lambda/2$ is satisfied even when the length a is equal to a maximum value $\lambda$. This causes the electromagnetic wave perpendicular to the electromagnetic wave to be cut off.

In the wireless communication device in accordance with the present embodiment, it is preferable that the through hole has an inner wall on which an inner wall conductor is formed so as to electrically connect a surface conductor and a rear surface conductor each provided on the mounting board.

With the arrangement, it is possible to reduce loss generated when radio waves pass through the though hole. This allows an increase in antenna efficiency.

In the wireless communication device in accordance with the present embodiment, it is preferable that a horn antenna, including a connecting section which has substantially the same opening size as the through hole, is connected to the through hole.

With the arrangement, all the radio wave radiated from the antenna is radiated from the horn antenna. Therefore, it is possible to realize an antenna with high efficiency.

It is preferable that the wireless communication device in accordance with the present embodiment, further includes a housing, connected to the horn antenna, in which the antenna-integrated module is contained.

With the arrangement, it is possible to realize a compact and light wireless communication device. Further, heat generated in the antenna-integrated module is promptly radiated into the air via the horn antenna. This causes the heat not to remain in the housing. This allows an improvement of reliability of the wireless communication device.

In the wireless communication device in accordance with the present embodiment, it is preferable that the through hole has an inner wall on which an inner wall conductor is formed so as to electrically connect a surface conductor and a rear surface conductor each provided on the mounting board.

In the wireless communication device in accordance with the present embodiment, it is preferable that a horn antenna, including a connecting section which has substantially the same opening size as the through hole, is connected to the through hole.

It is preferable that the wireless communication device in accordance with the present embodiment, further includes a housing, connected to the horn antenna, in which the antenna-integrated module is contained.

It is preferable that the wireless communication device in accordance with the present embodiment further includes a mortar-shaped structure having a lower circular opening and an upper circular opening, and a dielectric lens covering the mortar-shaped structure, the lower circular opening being provided above the through hole, and the dielectric lens being provided so as to cover the upper circular opening.

With the arrangement, all the waves radiated from the patch antenna are radiated from the dielectric lens. Therefore, it is possible to realize an antenna having a high efficiency.

In the wireless communication device in accordance with the present embodiment, it is preferable that the mortar-shaped structure is set to have a depth so that a focal point of the dielectric lens is positioned at the center of the lower circular opening.

With the arrangement, the wave radiated from the dielectric lens is converted into the plane wave. Therefore, it is possible to realize an antenna having a higher gain.

In the wireless communication device in accordance with the present embodiment, it is preferable that the lower circular opening has a diameter of substantially the same length as a longer side of the through hole.

With the arrangement, the wave radiated from the through hole is not scattered but enters into the dielectric lens.

In the wireless communication device in accordance with the present embodiment, it is preferable that the upper circular opening has a diameter of substantially the same length as the dielectric lens.

With the arrangement, it is possible to cause the wave radiated from the through hole to effectively enter into the periphery of the dielectric lens. This allows an increase in aperture efficiency of the dielectric lens.

In the wireless communication device in accordance with the present embodiment, it is preferable that the mortar-shaped structure is formed so as to be integral with a housing for containing the antenna-integrated module.

With the arrangement, it is possible to realize a compact and high-end wireless communication device with which an antenna is integral.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A wireless communication device comprising:

a mounting board having a through hole whose cross-sectional shape is rectangular; and an antenna-integrated module mounted on the mounting board so as to cover over the through hole, a patch antenna, which radiates radiation wave, being provided on a surface of the antenna-integrated module, which surface is exposed in the through hole, an annular grounding section being provided between the antenna-integrated module and the mounting board so as to surround the patch antenna, and the through hole having a longer side whose length a satisfies $\lambda/2 \leqq a \leqq \lambda$, where $\lambda$ is a wavelength of the radiation wave.

2. The wireless communication device according to claim 1, wherein the through hole has a shorter side whose length b satisfies $0 < b \leqq \lambda/2$, where $\lambda$ is the wavelength of the radiation wave.

3. The wireless communication device according to claim 1, wherein the through hole has an inner wall on which an inner wall conductor is formed so as to electrically connect a surface conductor and a rear surface conductor each provided on the mounting board.

4. The wireless communication device according to claim 1, wherein a horn antenna, including a connecting section which has substantially a same opening size as the through hole, is connected to the through hole.

5. The wireless communication device according to claim 4, further comprising a housing, connected to the horn antenna, in which the antenna-integrated module is contained.

6. The wireless communication device according to claim 1, further comprising a mortar-shaped structure having a lower circular opening and an upper circular opening, and a dielectric lens covering the mortar-shaped structure, the lower circular opening being provided above the through hole, and the dielectric lens being provided so as to cover the upper circular opening.

7. The wireless communication device according to claim 6, wherein the mortar-shaped structure is set to have a depth so that a focal point of the dielectric lens is positioned at a center of the lower circular opening.

8. The wireless communication device according to claim 6, wherein the lower circular opening has a diameter of substantially a same length as a longer side of the through hole.

9. The wireless communication device according to claim 6, wherein the upper circular opening has a diameter of substantially a same length as the dielectric lens.

10. The wireless communication device according to claim 6, wherein the mortar-shaped structure is formed so as to be integral with a housing for containing the antenna-integrated module.

11. A wireless communication device comprising:

a mounting board having a through hole whose cross-sectional shape is circular; and an antenna-integrated module mounted on the mounting board so as to cover over the through hole, a patch antenna, which radiates radiation wave, being provided on a surface of the antenna-integrated module, which surface is exposed in the through hole, an annular grounding section being provided between the antenna-integrated module and the mounting board so as to surround the patch antenna, and the through hole having a diameter whose length e satisfies $\lambda/1.706 \leqq e \leqq \lambda/1.3065$, where $\lambda$ is a wavelength of the radiation wave.

12. The wireless communication device according to claim 11, wherein the through hole has an inner wall on which an inner wall conductor is formed so as to electrically connect a surface conductor and a rear surface conductor each provided on the mounting board.

13. The wireless communication device according to claim 11, wherein a horn antenna, including a connecting section which has substantially a same opening size as the through hole, is connected to the through hole.

14. The wireless communication device according to claim 13, further comprising a housing, connected to the horn antenna, in which the antenna-integrated module is contained.

* * * * *